US005817210A

United States Patent [19]

Morin

[11] Patent Number: 5,817,210

[45] Date of Patent: Oct. 6, 1998

[54] THERMAL TRANSFER PRESS FOR IMPRINTING NOTE PAD CUBES

[75] Inventor: Mark W. Morin, Attleboro, Mass.

[73] Assignee: Geo. Knight & Co., Inc., Brockton, Mass.

[21] Appl. No.: 811,043

[22] Filed: Mar. 4, 1997

[51] Int. Cl.[6] ..... B30B 15/34

[52] U.S. Cl. ..... 156/583.9; 156/583.1; 100/233

[58] Field of Search ..... 156/580, 581, 156/583.1, 583.8, 583.9; 100/320, 326, 233, 283

[56] References Cited

U.S. PATENT DOCUMENTS

| | | | |
|---|---|---|---|
| 3,992,988 | 11/1976 | Dwyer | 156/583.9 X |
| 4,083,205 | 4/1978 | Clarke et al. | 156/583.9 X |
| 4,190,485 | 2/1980 | Takeda et al. | 156/583.9 |
| 4,243,470 | 1/1981 | Higashiguchi | 156/583.9 |
| 5,147,496 | 9/1992 | Hix | 156/583.8 |
| 5,401,354 | 3/1995 | Colucci | 156/580 |
| 5,435,883 | 7/1995 | Myers | 156/583.9 |

*Primary Examiner*—James Sells
*Attorney, Agent, or Firm*—John P. McGonagle

[57] ABSTRACT

A thermal transfer press for applying heat transfer style images to a plain paper cube. The press is comprised of a heater block assembly with thermal conductive material attached to a working surface; a mechanism that causes the heater block assembly to make flush parallel contact with the paper cube; and an adjustable clamping device for securing the paper cube during the imprinting process.

12 Claims, 8 Drawing Sheets

THERMAL TRANSFER PRESS FOR IMPRINTING NOTE PAD CUBES

BACKGROUND OF THE INVENTION

This invention relates to thermal transfer presses, and more particularly to a thermal transfer press for imprinting or imaging onto note pad cubes.

Heat transfer printing is the printing of sublimation transfers, plastisol and other ink type transfers as well as images created using specially coated papers fed through color copy machines and other color printers onto objects by heating or thermal application. The heat transfer process involves transferring printed transfers by heat and contact pressure. In order to print using thermal transfers, a properly prepared transfer must be held in tight contact with the receptive surface while heat is applied. The heat and pressure must continue for a sufficient time to allow the sublimation process to complete itself.

The ability to apply images to note pad cubes is not in itself unique. What is unique is the ability to apply heat transfer style images to a plain (and not treated) paper cube. Present technology requires a film "coating" to be applied to the paper cube prior to transfer application. The present invention overcomes this limitation by incorporating the "coating" into a transfer image carrier paper and using a special heat-conductive rubber pad to successfully apply an image to a note cube.

SUMMARY OF THE INVENTION

The present invention provides a thermal transfer press for applying heat transfer style images to a plain paper cube. The press is comprised of a heater block assembly with thermal conductive material attached to a working surface; a mechanism that causes the heater block assembly to make flush parallel contact with the paper cube; and an adjustable clamping device for securing the paper cube during the imprinting process.

It is, therefore, an object of the invention to provide a thermal transfer press to affix an image to an untreated note pad cube by sublimation transfer, plastisol and other ink type transfers as well as images created using specially coated papers fed through color copy machines and other color printers onto objects by heating or thermal application.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
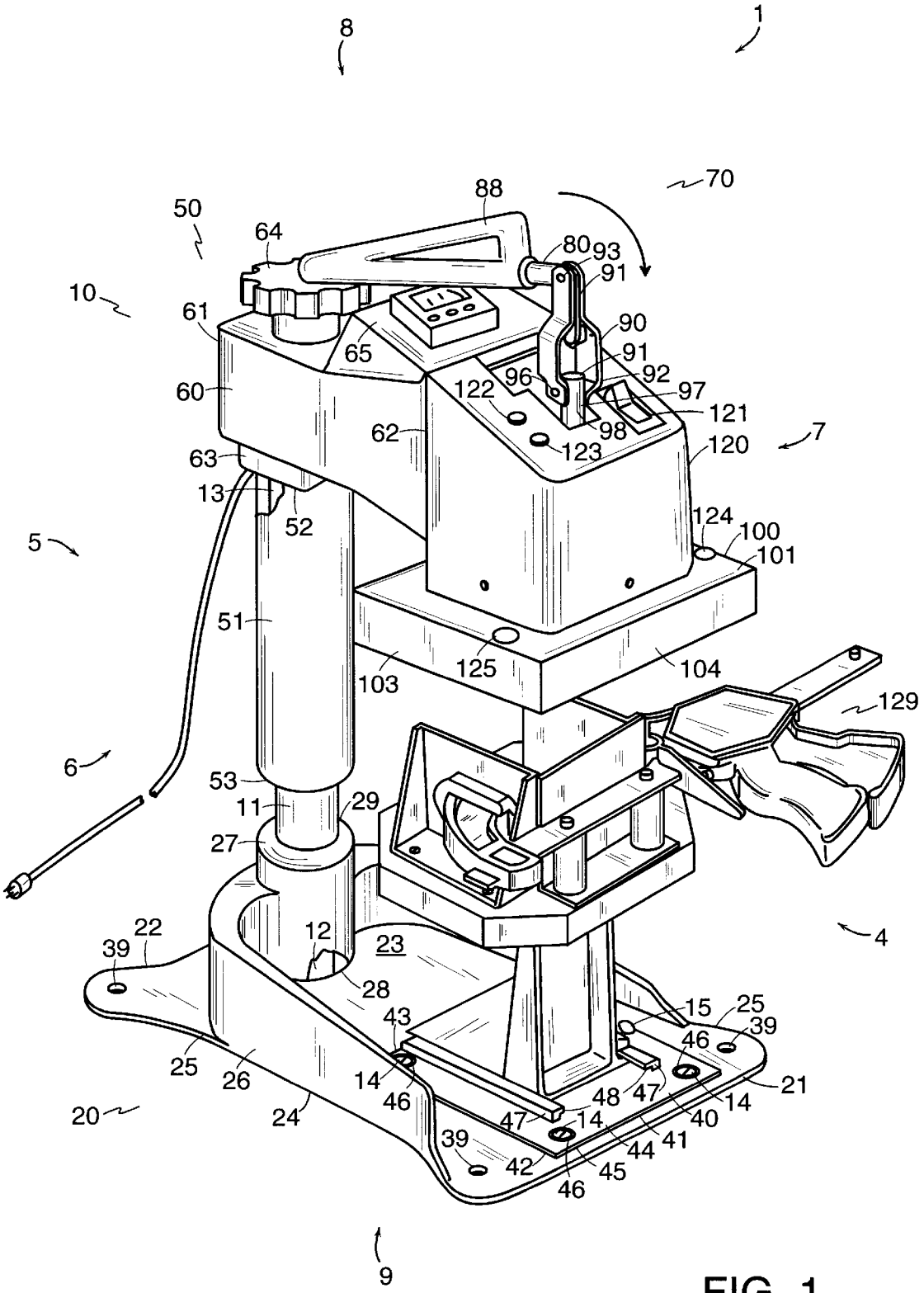
FIG. 1 is a front perspective view of a press constructed according to the present invention.
Figure 2A:
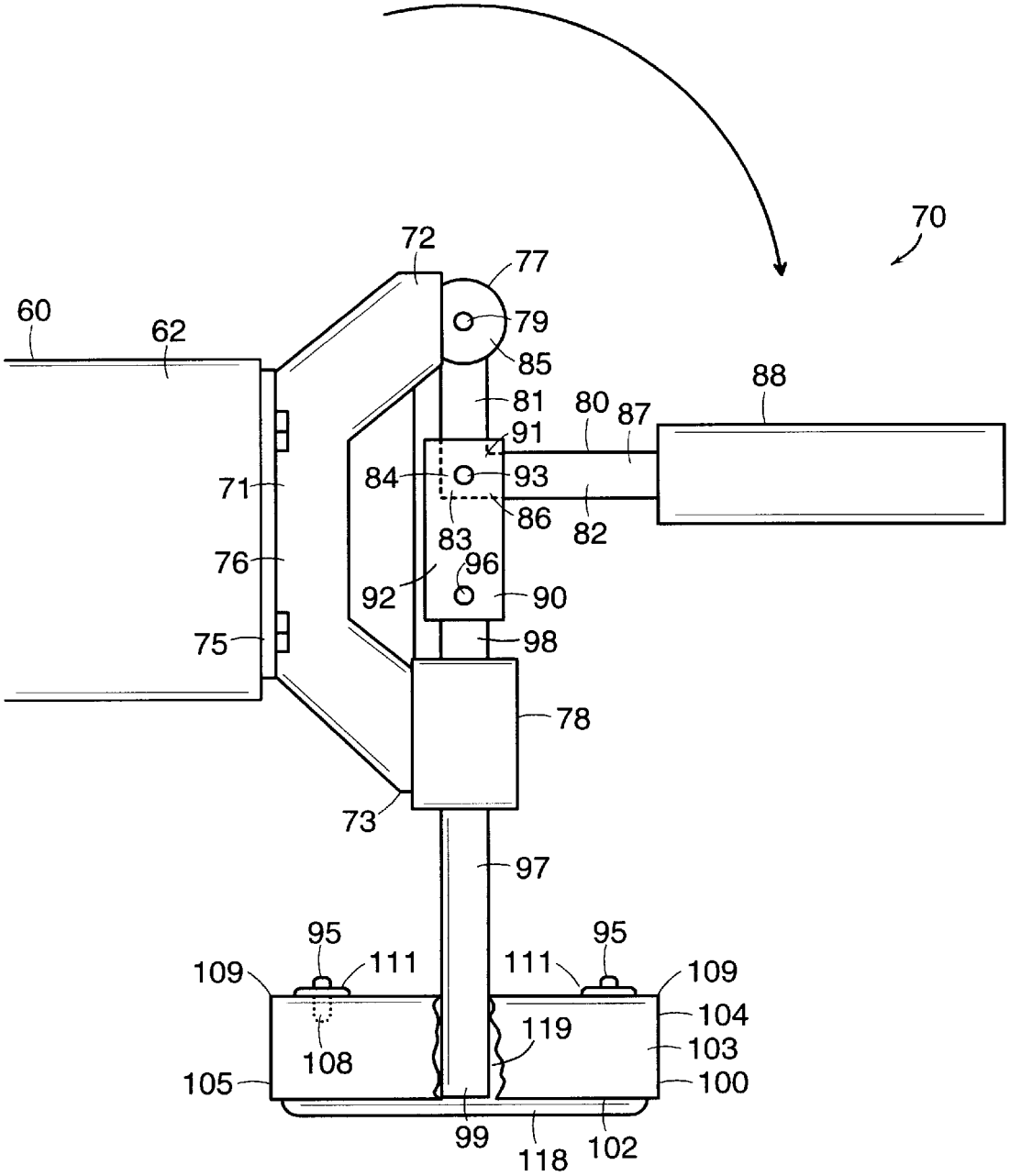
FIG. 2A is a close up, side, sectional view of the handle portion of the contact mechanism, with the heater block assembly engaged.
Figure 2B:
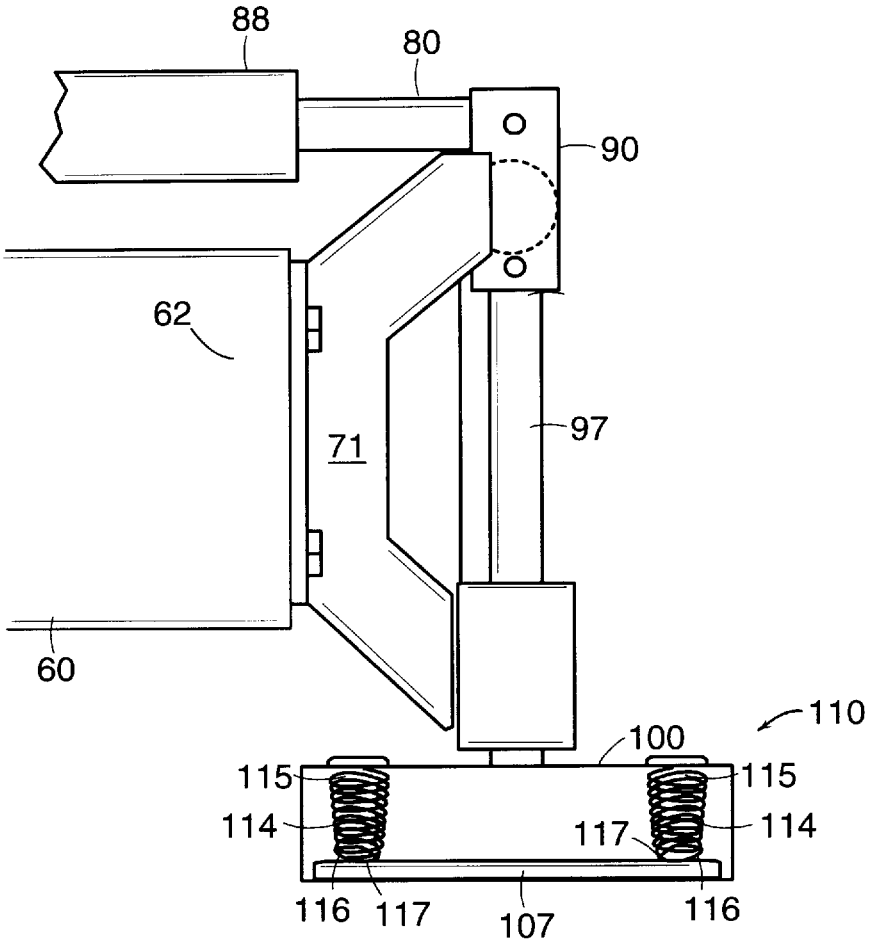
FIG. 2B is a close up, side, sectional view of the handle portion of the contact mechanism, with the heater block assembly disengaged.
Figure 3:
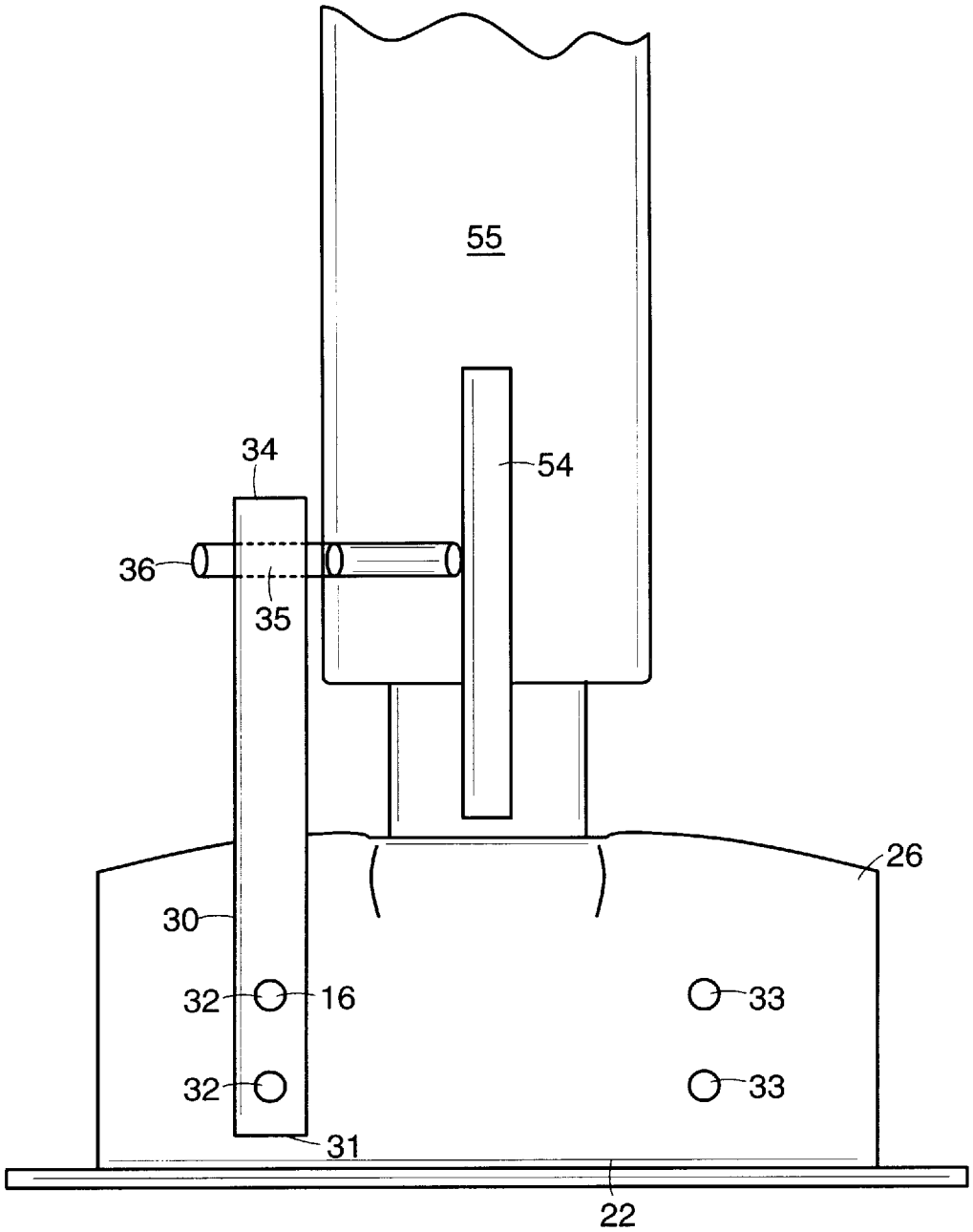
FIG. 3 is a rear view of the lower base of the press.
Figure 4:
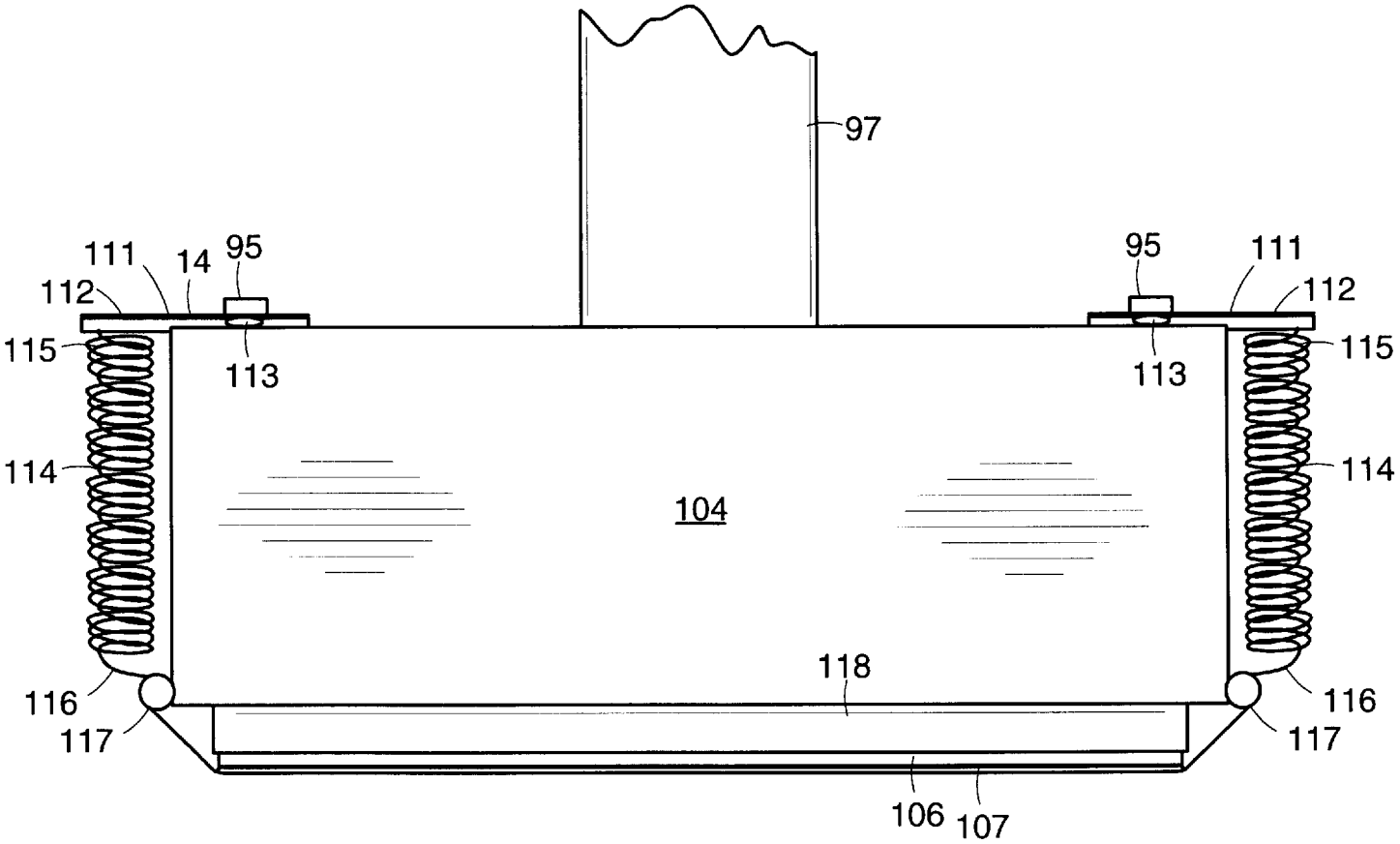
FIG. 4 is a close up front view of the heater block assembly.
Figure 5:
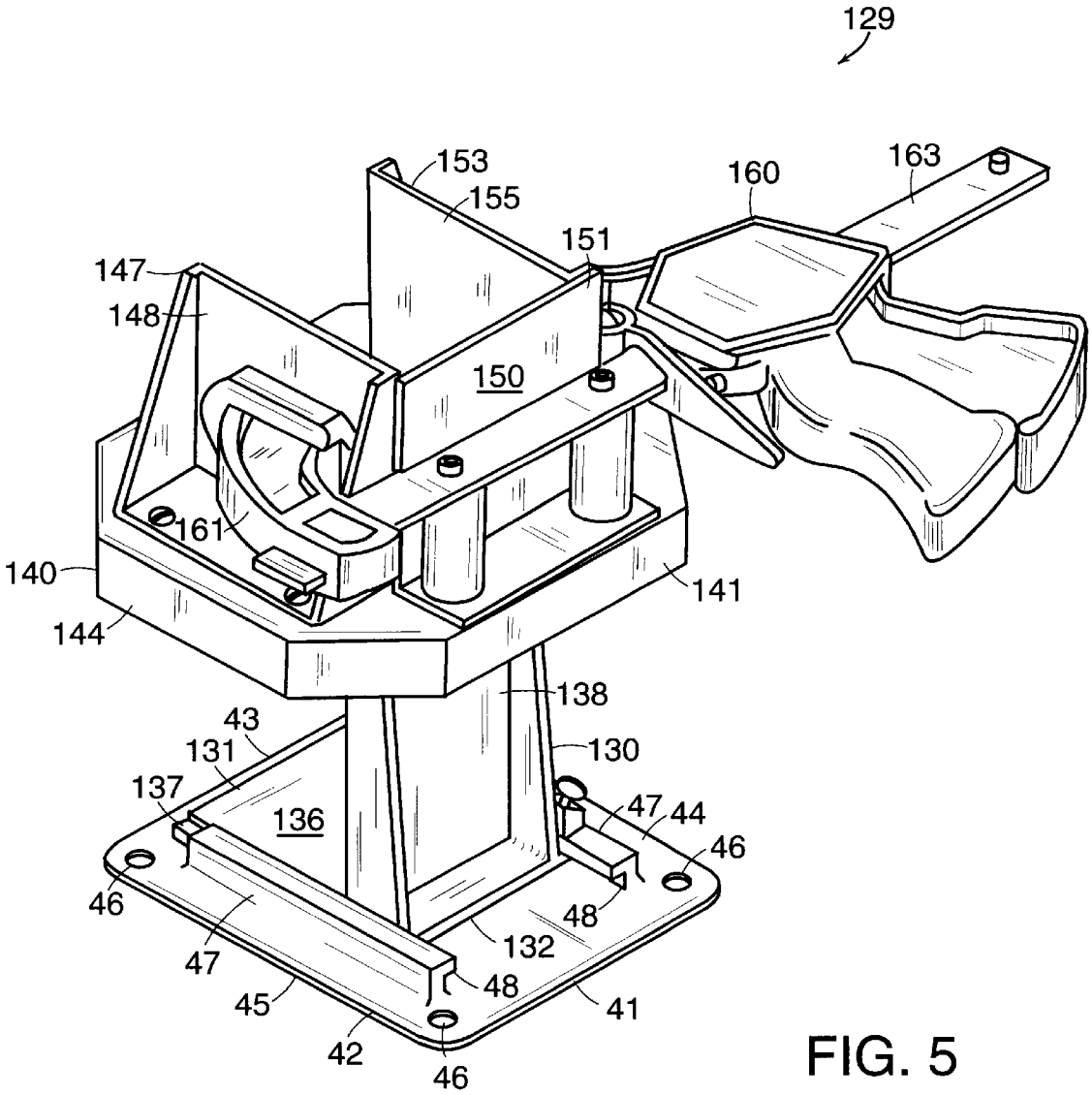
FIG. 5 is a front perspective view of the paper cube adjustable clamping device.
Figure 6:
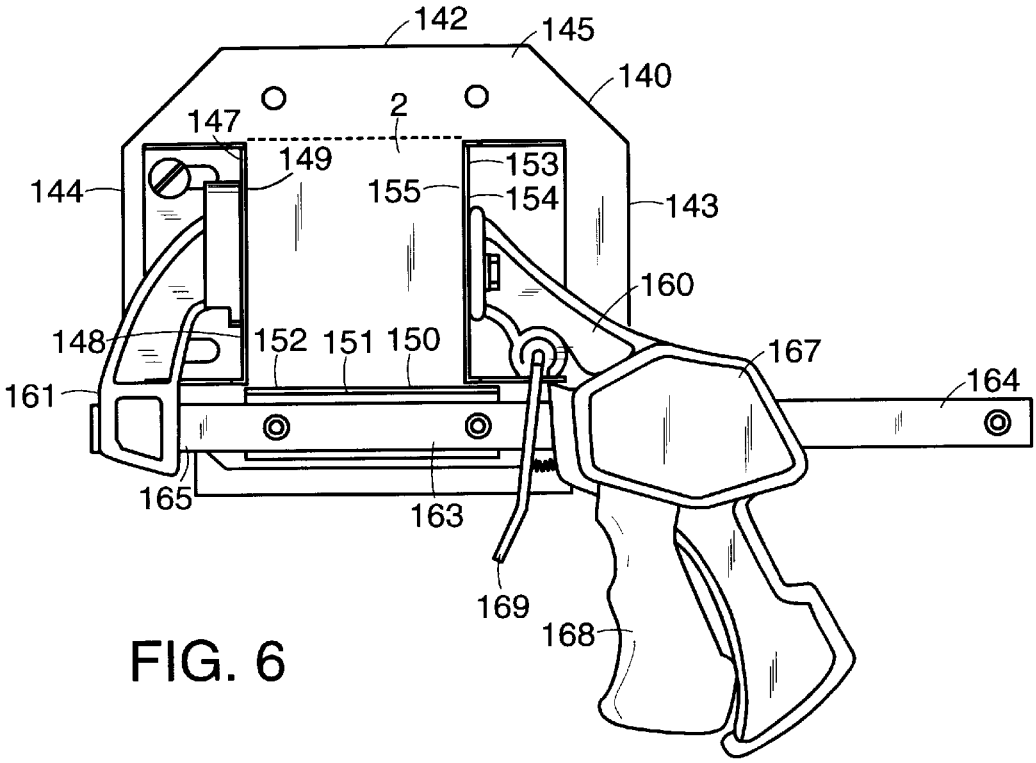
FIG. 6 is a top plan view of the clamping device of FIG. 5.
Figure 7:
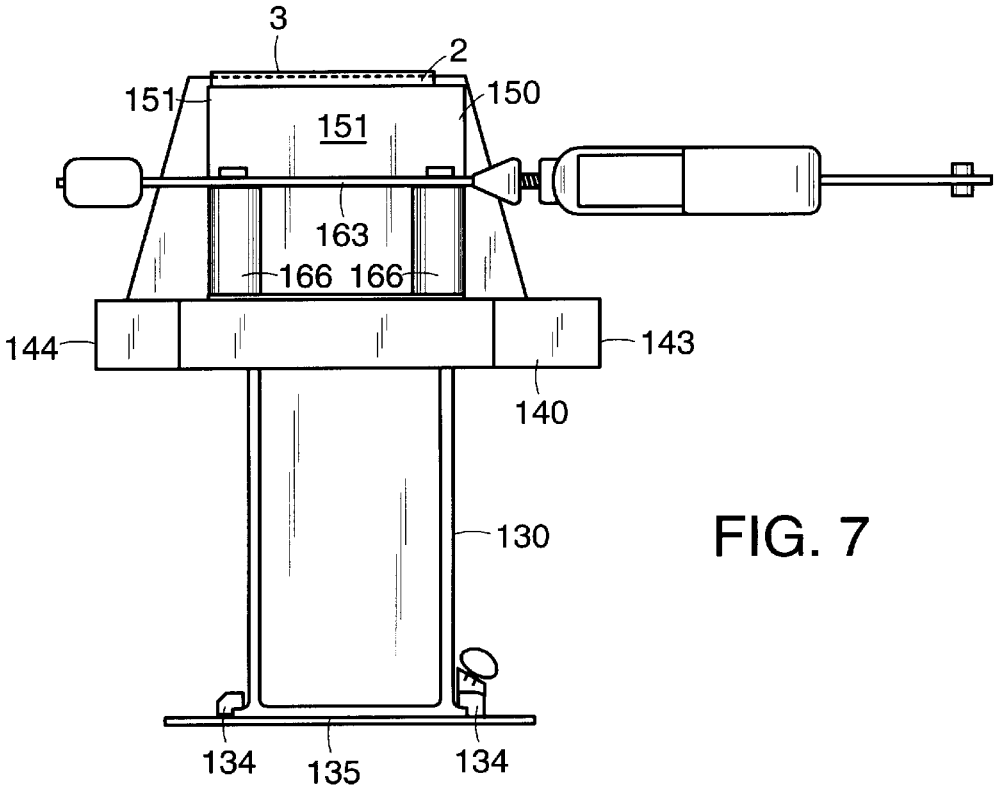
FIG. 7 is a front view of the clamping device of FIG. 5.
Figure 9:
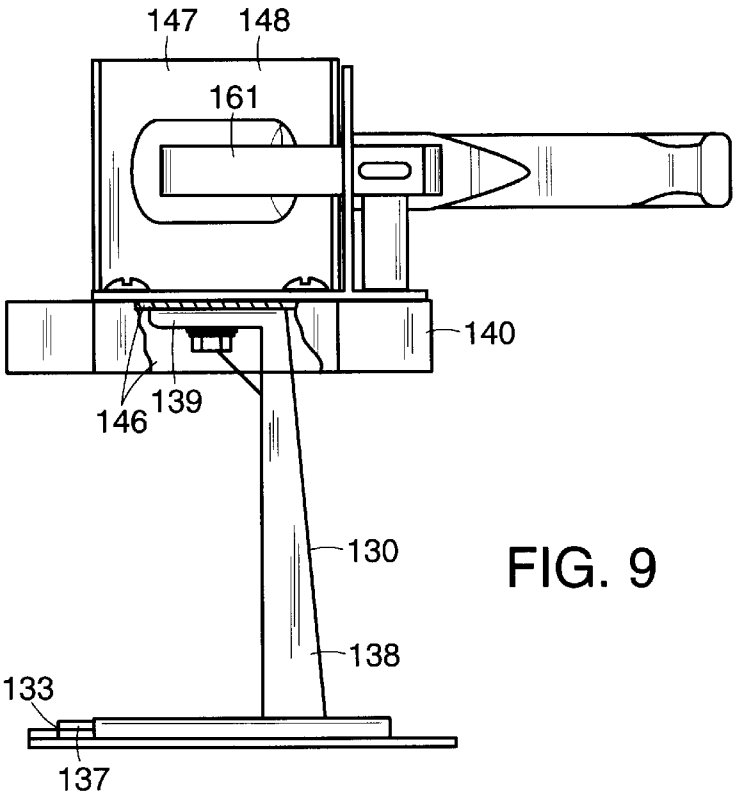
FIG. 9 is a left side view of the clamping device of FIG. 5.
Figure 8:
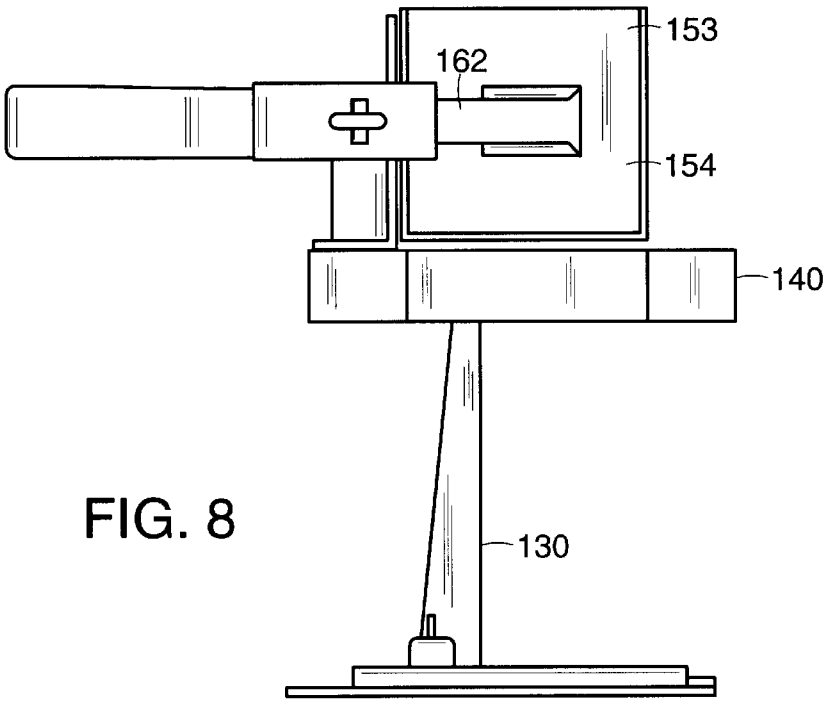
FIG. 8 is a right side view of the clamping device of FIG. 5.

Referring to the drawings in detail wherein like elements are indicated by like numerals, there is shown in FIG. 1 a thermal transfer press 1 constructed according to the principles of the present invention. The press 1 has a front 4, back 5, left side 6, right side 7, top 8 and bottom 9. For purposes of exposition all components of the invention will be referred positionally with respect to these directions. The press 1 is comprised of a heat platen 100, a contact mechanism 10 for positioning the heat platen 100 into flush contact with a plain paper cube 2, and an adjustable clamping device 129 for holding the paper cube 2 in position during the process.

The contact mechanism 10 is comprised of a base 20, a vertical rod 11 projecting vertically upward from said base 20, and a "swing-away" heater block assembly 50 joined to said vertical rod 11. The base 20 has a generally rectangular plate-like shape, having a front edge 21, a rear edge 22, a top surface 23, a bottom surface 24, and two side edges 25. The side edges 25 and rear edge 22 have a continuous flange 26 projecting vertically upward from the base top surface 23. The flange 26 portion along the rear edge 22 has a hollow cylindrical element 27 formed therein, said element 27 having a vertical, central, longitudinal axis. The element 27 has two ends, a bottom end 28 opening onto said base top surface 23 and an upper open end 29 projecting vertically upward. The upwardly projecting element end 29 is open. One end 12, i.e., lower end, of the vertical rod 11 is fixedly inserted into said hollow cylindrical element 27 through the element open end 29 to the junction of the element end 28 and the base top surface 23. The other vertical rod end 13, i.e., upper end, projects vertically upward. The base 20 has a hole 39 formed near to each of its corners. This permits the invention 1 to be rigidly secured to a working surface.

The base top surface 23 has a generally rectangular holding plate 40 removably attached thereto. The holding plate 40 has a front edge 41, two side edges 42, a rear edge 43, an upper surface 44 and an under surface 45. The holding plate under surface 45 rests on the base top surface 23. The holding plate front edge 41 is aligned with the base front edge 21. The holding plate side edges 42 are generally parallel to the base side edges 25. The holding plate rear edge 43 is generally parallel to the base rear edge 22. The holding plate 40 is joined to the base by means of four screw fasteners 14 each inserted through one of four holding plate corner holes 46 and then into corresponding holes (not shown) formed in the base 20. The holding plate 40 has an elongated ridge element 47 formed near to and parallel to each side edge 42. Each ridge element 47 has a cross sectional shape similar to an inverted "L" whereby the bottom of the "L" projects inwardly away from an adjacent side edge 42 forming an interior, elongated channel 48. One of the ridge channels 48' has a hole (not shown) with a wing nut 15 projecting through. The holding plate ridge element channels 48 are adapted to hold a generally rectangular, plate-like object against the holding plate upper surface 44. The wing nut 15 provides a means for securing the object in place.

The "swing-away" heater block assembly 50 is comprised of a hollow, vertical, cylindrical sleeve 51, a horizontal support element 60 attached to the cylindrical sleeve 51, and a handle press assembly 70 also attached to said horizontal support element 60. The cylindrical sleeve 51 has an upper end 52 and an open lower end 53. The cylindrical sleeve 51 is fitted over the vertical rod 11. The cylindrical sleeve upper end 52 terminates in the horizontal support element 60. The horizontal support element 60 has a rear end 61, a forward end 62, and a top 65. The horizontal support element rear end 61 terminates in an adjustment mechanism 63. The cylindrical sleeve upper end 52 is joined to the horizontal support element rear end 61 by means of the adjustment mechanism 63. The adjustment mechanism 63 controls the height of the horizontal support element 60. By turning the adjustment mechanism knob 64 clockwise, the cylindrical sleeve 51 is raised upward along the vertical rod 11, thereby raising the height of the horizontal support element 60. By turning the adjustment mechanism knob 64 counter-clockwise, the cylindrical sleeve 51 is lowered along the vertical rod 11, thereby lowering the height of the horizontal support element 60.

The cylindrical sleeve 51 is adapted to radially turn on the vertical rod 11. To control the direction of swing, a clamp stop bracket 30 is attached to the base rear edge 22 portion of the flange 26. The clamp stop bracket 30 is a vertical element having two holes 32 formed near to its lower end 31. Fasteners 16 are inserted through the holes 32 into a corresponding set of holes 33 formed in the base rear edge 22 portion of the flange 26. Another hole 35 is formed transverse to the direction of the lower holes 32 near to the clamp stop bracket upper end 34. An adjustment pin 36 is inserted through the upper hole 35. The cylindrical sleeve has an vertically elongated, block-like element 54 attached to one side near to its open lower end 53 and extending past its lower end 53. The block-like element 54 is attached to the cylindrical sleeve side 55 farthest from the horizontal support element forward end 62. The cylindrical sleeve block-like element 54 is adapted to engage the clamp stop bracket adjustment pin 36 when the horizontal support element forward end 62 is directly aligned with the base front edge 21.

The horizontal support element forward end 62 terminates in a handle press assembly 70. The handle press assembly 70 joins the heat platen 100 with the horizontal support element 60. The handle press assembly 70 has a vertical bracket 71 attached to the horizontal element forward end 62. The vertical bracket 71 has a top portion 72, a bottom portion 73, a front 74, a rear 75 and two sides 76. The top portion 72 has two, parallel, forwardly projecting, D-shaped elements 77 vertically attached to the bracket top portion 72 front 74. The bottom portion 73 has a hollow cylindrical element 78 with two open ends and a vertical central axis attached to the bracket bottom portion 73 front 74. The handle press assembly 70 includes a right angle piece 80 having two sides 89, said right angle piece 80 being formed from two elongated elements, one element being termed the pivot element 81 and the other element being termed the handle element 82. The pivot element 81 has two ends, a juncture end 84 and a pivot end 85. The handle element 82 also has two ends, a juncture end 86 and an end 87 terminating in a handle 88. The pivot element juncture end 84 and handle element juncture end 86 are joined forming a juncture 83. The pivot element pivot end 85 is inserted between the D-shaped elements 77 and rotatably held between the elements 77 with a pin 79. The right angle piece 80 is thereby adapted to rotate 180 ° in a vertical plane. This results in the handle 88 being movable from one extreme position in a horizontal plane in front 4 of the invention 1 to a second extreme position in a horizontal plane over the top 65 of the horizontal support element 60.

The handle press assembly 70 includes two C-shaped, holding brackets 90, each having an upper end 91 and a lower end 92. The upper end 91 of each holding bracket 90 is rotatably attached with a pin 93 to the right angle piece juncture 83, one on each side 89. The holding brackets 90 are attached so that each bracket 90 bows outward from the vertical plane of the right angle piece 80. The lower end 92 of each holding bracket 90 is rotatably attached by means of a pin 96 to the radially opposite sides of the upper end 98 of a cylindrical element 97 having a vertical central axis. The cylindrical element 97 has a lower end 99 threadingly attached to the heat platen 100.

The heat platen 100 has a generally rectangular, block-like shape with a top surface 101, bottom surface 102, two side walls 103, a front wall 104, and a rear wall 105. The top surface 101 and bottom surface 102 lie in parallel horizontal planes and, in this embodiment, have 6"×8" dimensions. The heat platen 100 has a taped hole 119 formed centrally through the top surface 101 to and through the bottom surface 102. The cylindrical element 97 is attached to the heat platen top surface 101 and into the taped hole 119. The heat platen bottom surface 102 is covered by an aluminum plate 118, which in turn is covered by a silicone rubber pad 106 and wrapped with a TEFLON fabric sheet 107, all held in place with a lifter spring mechanism 110. The aluminum plate 119 covers the taped hole 118 and presents an even, uniform heating surface. The rubber pad 106 is comprised of a ⅛ inch thick, heat conductive, silicone sponge which absorbs inconsistencies on the surface of the paper cube 2 and allow consistent imprinting via a transfer sheet onto the paper cube surfaces. The TEFLON fabric sheet 107 is comprised of a 6 mil Teflon, fiberglass fabric whose purpose is to substantially reduce the tendency of the rubber pad 106 to stick to a transfer sheet.

The lifter spring mechanism 110 is comprised of four, flat, elongated attachment elements 111 and four mounting spring elements 114. The attachment elements 111 have a hole 112, 113 formed near to each end. The heat platen 100 has four holes 108 formed in its top surface 101, one located near to each corner 109. For each attachment element 111, a fastener 95 is inserted through one 113 of the attachment element holes 112, 113 into a corresponding heat platen corner hole 109. Each attached attachment element 111 is then positioned so that each attachment element unattached hole 112 protrudes over a heat platen side wall 103. Each mounting spring element 114 is an elongated, spiral spring with two ends 115, 116 formed into hooks. Each first spring end 115 is attached to a separate protruding attachment element protruding hole 112. Each second spring end 116 is attached to a corresponding hole 117 in the TEFLON fabric sheet 107.

The heat platen 100 has a console 120 mounted on its top surface 101. The console 120 contains an invention "ON/OFF" switch 121, a "HEATING" red light 122, and an "AT HEAT" green light 123. When the invention "ON/OFF" switch 121 is turned on, the "HEATING" light 122 will illuminate and remain on until the desired temperature is reached. The "HEATING" light 122 will then turn off and the "AT HEAT" light 123 will illuminate. The heat platen top surface 101 also contains a thermostat control 124 near to the right side wall 103'. The heat platen 100 will normally heat to a factory set 350° F. If the thermal transfer process requires a higher or lower temperature, the thermostat control 124 may be adjusted accordingly. A heat platen temperature gauge 125 is also mounted on the heat platen top surface 101 near to the left side wall 103 " so that heat platen temperature may be accurately monitored. A digit timer 126 is mounted on the horizontal support element top 65 near to the forward end 62. The digital timer 126 permits accurate dwell time monitoring.

The invention 1 is further comprised of an adjustable clamping device 129 for holding the paper cube 2 in position during the imprinting process. The clamping device 129 is comprised of a pedestal 130, a fixture table 140 mounted on the pedestal 130, and a bar clamp 160 for manipulation of the fixture table 140. The pedestal 130 has a flat, horizontal, base element 131 with a front edge 132, rear edge 133, two side edges 134, a flat bottom surface 135 and a generally flat upper surface 136. The base element 131 longitudinal axis extends from the front edge 132 to the rear edge 133. The upper surface 136 has two elongated channels 137 formed therein, one along each side edge 134. The pedestal 130 is joined to the invention by insertion of the pedestal base element 131 onto the holding plate upper surface 44, so that the base element channels 137 engage the holding plate elongated channels 48. The holding plate wing nut 15 is then tightened, thereby firmly holding the pedestal 130 in place on the holding plate 40.

The pedestal 130 has a generally rectangular vertical support element 138 formed near to the base front edge 132, extending from the base upper surface 136 at right angles to the base upper surface 136 vertically upward. The vertical support element 138 terminates at its highest point in a right angle flange 139, said flange 139 lying in a plane parallel to the plane of the base upper surface 136 and extending rearwardly.

A fixture table 140 is fixedly mounted on said vertical support element flange 139. In this embodiment of the invention 1 the fixture table 140 has an octagonal shape and lies in a plane parallel to the pedestal flat base element 131. Among the eight fixture table sides, is a front side 141 corresponding to the invention front 4, a rear side 142 corresponding to the invention back 5, a right side 143 corresponding to the invention right side 7, and an opposite left side 144 corresponding to the invention left side 6. The fixture table 140 has a flat top surface 145 and a bottom surface 146 fixedly attached to said support element flange 139. A generally rectangular first plate 147 is fixedly attached to the top surface 145 near to the left side 144 in a vertical plane parallel to said left side 144 and transverse to the plane of the top surface 145. The first plate 147 has an exterior surface 148 facing out from the invention left side 6 and an interior surface 149 facing the invention right side 7. A generally rectangular second plate 150 is fixedly attached to the top surface 145 near to the front side 141 in a vertical plane parallel to said front side 141 and transverse to the plane of the top surface 145. The second plate 150 has an exterior surface 151 facing out from the invention front 4 and an interior surface 152 facing the invention back 5.

The adjustable clamping device 129 is further comprised of a bar clamp 160 having a fixed jaw 161, a movable jaw 162, and a slide bar 163. The fixed jaw 161 is attached to one end 165 of the slide bar 163 and the movable jaw 162 is mounted on the other end 164 of the slide bar 163, said fixed jaw 161 and movable jaw 162 face in opposite directions. The bar clamp 160 lies in a horizontal plane above and parallel to the fixture table top surface 145. The bar clamp fixed jaw 161 is fixedly attached to said first plate exterior surface 148. The slide bar 163 is attached to and supported by two vertical support elements 166 fixedly attached to the fixture table top surface 145 between the second plate exterior surface 151 and the fixture table front side 141. The movable jaw 162 has a generally rectangular third plate 153 fixedly attached thereto near to the fixture table right side 143 in a vertical plane parallel to said fixture table right side 143 and transverse to the plane of the fixture table top surface 145. The third plate 153 has an exterior surface 154 facing out from the invention right side 7 and an interior surface 155 facing the invention left side 6. The third plate 153 is positioned opposite to and in parallel to the first plate 147. The movable jaw 162 is fixedly attached to said third plate exterior surface 154. The bar clamp is further comprised of a drive means 167 attached to said movable jaw 162, said drive means 167 engaging said slide bar 163 and being adapted to move said attached movable jaw 162 with attached third plate 153 along said slide bar 163 toward and away from said fixed jaw 161 and first plate 147. The drive means 167 is a one-way drive means which, by operation of a trigger handle 168, releasably engages the slide bar 163 and advances the movable jaw 162 with attached third plate 153 toward the fixed jaw 161 with attached first plate 147. The one-way drive means is incapable of moving the movable jaw 162 along the slide bar 163 away from the fixed jaw 161. Return motion of the movable jaw 162 is accomplished manually when the one-way drive means is disengaged. The bar clamp 160 utilized in this invention is a modification of the bar clamp disclosed in U.S. Pat. No. 5,009,134, issued on Apr. 23, 1991, to J. A. Sorensen et al., entitled "Quick-Action Bar Clamp", and assigned to Petersen Manufacturing Co., Inc. The disclosure of this patent is incorporated by reference.

OPERATION

The invention 1 is turned on and the heat block assembly 50 is swung around to one side. As the heat platen 100 heats, the adjustable clamping device 129 is opened by squeezing the release switch 169 and sliding the movable jaw 162 and drive means 167 to the right along the slide bar 163. A paper cube 2 is placed on the fixture table top surface 145 against the first plate interior surface 149 and second plate interior surface 152. The bar clamp drive means trigger handle 168 is squeezed and the movable jaw 162 with attached third plate 153 is moved toward the fixed jaw 161 until the third plate interior surface 155 is snugly against the paper cube 2. A transfer sheet 3 is placed flush against the exposed top of the cube 2 on the first surface to be printed. When the "AT HEAT" light 123 turns on, the heat block assembly 50 is swung around until the heat platen 100 is aligned directly over the paper cube 2 to be printed. The handle 88 on the handle press assembly 70 is grasped and pulled directly forward thereby lowering the heat platen 100 onto the adjustable clamping device 129 and applying heat and pressure to the transfer sheet 3 and paper cube 2 for a desired amount of time. The handle 88 is then raised and pushed back over the horizontal support element top 65 thereby raising the heat platen 100 from the paper cube 2. After pressing the first cube surface, the release switch 169 is squeezed and the clamping device 129 loosened slightly. Taking hold of the cube 2 from the back surface, the cube 2 is rotated (leaving the transfer sheet 3 on) by one side so that the printed side is facing rearward. The clamping device 129 is then tightened firmly on the cube again and the transfer 3 is folded down onto the subsequent unprinted surface facing up. The heat press procedure described above is then repeated. The result will be a fully printed cube 2 with the transfer image wrapping seamlessly around the cube.

It is understood that the above-described embodiment is merely illustrative of the application. Other embodiments may be readily devised by those skilled in the art which will embody the principles of the invention and fall within the spirit and scope thereof.

I claim:

1. A thermal transfer press for imprinting note pad cubes, said press having a front, back, left side, right side, top and bottom, comprising:

a heat platen with thermal conductive material attached to a working surface;

a contact mechanism for positioning the heat platen in flush parallel contact with said note pad cube, said contact mechanism being comprised of a base, a rod having a lower end and an upper end, said rod projecting vertically upward from said base, and a pivotal heater block assembly joined to said vertical rod;

an adjustable clamping device joined to said contact mechanism base, said device adapted to hold said note pad cube in a desired position, said clamping device being comprised of a pedestal, a fixture table mounted on the pedestal, and a bar clamp for manipulation of the fixture table;

wherein said fixture table is comprised of:

a front side corresponding to the press front;

a rear side corresponding to the press back;

a right side corresponding to the press right side;

an opposite left side corresponding to the press left side;

a flat top surface;

a bottom surface fixedly attached to said pedestal;

a generally rectangular first plate fixedly attached to the top surface near to the left side in a vertical plane parallel to said left side and transverse to the plane of the top surface, said first plate having an exterior surface facing out from the press left side and an interior surface facing the press right side;

a generally rectangular second plate fixedly attached to the top surface near to the front side in a vertical plane parallel to said front side and transverse to the plane of the top surface, said second plate having an exterior surface facing out from the press front and an interior surface facing the press back; and wherein said bar clamp is comprised of:

a slide bar having two ends, said slide bar lying in a horizontal plane above and parallel to the fixture table top surface, said slide bar being attached to and supported by two vertical support elements fixedly attached to the fixture table top surface between the second plate exterior surface and the fixture table front side;

a fixed jaw attached to one end of the slide bar and fixedly attached to said first plate exterior surface;

a movable jaw mounted on the other end of the slide bar, said fixed jaw and movable jaw facing in opposite directions, said movable jaw having a generally rectangular third plate fixedly attached thereto near to the fixture table right side in a vertical plane parallel to said fixture table right side and transverse to the plane of the fixture table top surface, said third plate having an exterior surface facing out from the press right side and an interior surface facing the press left side, said third plate being positioned opposite to and in parallel to the first plate, said movable jaw being fixedly attached to said third plate exterior surface; and a drive means having a trigger handle and being attached to said movable jaw, said drive means engaging said slide bar and being adapted to move said attached movable jaw with attached third plate along said slide bar toward and away from said fixed jaw and first plate.

2. A thermal transfer press as recited in claim 1, wherein:

said drive means is a one-way drive means which is adapted to, by operation of said trigger handle, releasably engage the slide bar and advance the movable jaw with attached third plate toward the fixed jaw with attached first plate, said one-way drive means being incapable of moving the movable jaw along the slide bar away from the fixed jaw, wherein a return motion of the movable jaw is accomplished manually by disengaging the one-way drive means.

3. A thermal transfer press as recited in claim 2, wherein said pivotal heater block assembly is comprised of:

a hollow, vertical, cylindrical sleeve fitted over said vertical rod, said sleeve having an upper end and an open lower end, wherein said cylindrical sleeve is adapted to radially turn on the vertical rod;

a horizontal support element having a rear end, a forward end, and a top, said rear end terminating in an adjustment mechanism, said cylindrical sleeve upper end being joined to the horizontal support element rear end by means of said adjustment mechanism, said adjustment mechanism being adapted to adjust the vertical position of cylindrical sleeve along the vertical rod; and a handle press assembly attached to said horizontal support element, said handle press assembly being adapted to join the heat platen with the horizontal support element.

4. A thermal transfer press as recited in claim 3, wherein said handle press assembly is comprised of:

a vertical bracket attached to the horizontal element forward end, said vertical bracket having a top portion, a bottom portion, a front, a rear and two sides, said top portion having two, parallel, forwardly projecting, D-shaped elements vertically attached to the bracket top portion front, said bottom portion having a hollow cylindrical element with two open ends and a vertical central axis attached to the bracket bottom portion front;

a right angle piece having two sides, said right angle piece being formed from an elongated pivot element and from an elongated handle element, said pivot element having two ends, a juncture end and a pivot end, said handle element also having two ends, a juncture end and an end terminating in a handle, said pivot element juncture end and handle element juncture end being joined forming a juncture, wherein said pivot element pivot end is inserted between the D-shaped elements and rotatably held between the elements with a pin, wherein said right angle piece is thereby adapted to rotate 180° in a vertical plane, from a first extreme position in a horizontal plane in front of the press to a second extreme position in a horizontal plane over the top of the horizontal support element;

two C-shaped, holding brackets, each having an upper end and a lower end, said upper end of each holding bracket being rotatably attached with a pin to the right angle piece juncture, one on each side, said holding brackets being attached so that each bracket bows outward from the vertical plane of the right angle piece, said lower end of each holding bracket being rotatably attached by means of a pin to the radially opposite sides of the upper end of a cylindrical element having a vertical central axis, said cylindrical element having a lower end attached to the heat platen.

5. A thermal transfer press as recited in claim 4, wherein:

said heat platen has a generally rectangular, block-like shape with a top surface, bottom surface, two side walls, a front wall, and a rear wall, said top surface and bottom surface lying in parallel horizontal planes, said heat platen having a taped hole formed centrally through the top surface to and through the bottom surface, wherein said cylindrical element is attached to the heat platen top surface and into the taped hole.

6. A thermal transfer press as recited in claim 5, wherein:

said heat platen bottom surface is covered by an aluminum plate, which in turn is covered by a silicone rubber pad and wrapped with a tough non-sticking polymer fabric sheet, all held in place with a lifter spring mechanism.

7. A thermal transfer press as recited in claim 6, wherein said lifter spring mechanism is comprised of:

four, flat, elongated attachment elements, each having two ends and each having a hole formed near to each said end;

four mounting spring elements each comprised of an elongated, spiral spring with two ends formed into hooks;

four holes formed in the heat platen top surface, one located near to each top surface corner;

four fasteners, each inserted through one of the attachment element holes into a corresponding heat platen corner hole, wherein each attachment element is positioned so that each attachment element unattached hole protrudes over a heat platen side wall;

wherein each first spring end is attached to a separate protruding attachment element protruding hole, and each second spring end s attached to a corresponding hole in the tough, non-sticking polymer fabric sheet.

8. A thermal transfer press as recited in claim 7, wherein:

said contact mechanism base has a generally rectangular plate-like shape, having a front edge, a rear edge, a top surface, a bottom surface, and two side edges, said side edges and rear edge having a continuous flange projecting vertically upward from the base top surface, said flange having a portion along the rear edge having a hollow cylindrical element formed therein, said element having a vertical, central, longitudinal axis, said element having two ends, a bottom end opening onto said base top surface and an upper open end projecting vertically upward, said upwardly projecting element end being open;

wherein said vertical rod lower end is fixedly inserted into said hollow cylindrical element through the element open end to the junction of the element end and the base top surface, said vertical rod upper end projecting vertically upward.

9. A thermal transfer press as recited in claim 8, further comprising:

a clamp stop bracket attached to the base rear edge portion of the flange and adapted to control the direction of swing, said clamp stop bracket being a vertical element with an upper and lower end, said bracket having two holes formed near to its lower end;

two fasteners, each one inserted through a clamp stop bracket lower end hole into a corresponding hole formed in the base rear edge portion of the flange;

a hole formed near to the clamp stop bracket upper end transverse to the direction of the lower end holes;

an adjustment pin inserted through the upper hole;

a vertically elongated, block-like element attached to one side of the cylindrical sleeve near to its open lower end and extending past its lower end, said block-like element being attached to the cylindrical sleeve side farthest from the horizontal support element forward end, said cylindrical sleeve block-like element being adapted to engage the clamp stop bracket adjustment pin when the horizontal support element forward end is directly aligned with the base front edge.

10. A thermal transfer press as recited in claim 9, further comprising:

a generally rectangular holding plate removably attached to the base top surface, said holding plate having a front edge, two side edges, a rear edge, an upper surface and an under surface, said holding plate under surface resting on the base top surface, said holding plate front edge being aligned with the base front edge, said holding plate side edges being generally parallel to the base side edges, said holding plate rear edge being generally parallel to the base rear edge, said holding plate being joined to the base by means of four screw fasteners each inserted through one of four holding plate corner holes and then into corresponding holes formed in the base, said holding plate having an elongated ridge element formed near to and parallel to each side edge, each said ridge element having a inverted "L" cross sectional shape whereby the bottom of the "L" projects inwardly away from an adjacent side edge forming an interior, elongated channel, one of said ridge channels having a hole with a wing nut projecting through, said holding plate ridge element channels being adapted to hold a generally rectangular, plate-like object against the holding plate upper surface.

11. A thermal transfer press as recited in claim 10, further comprising:

a flat, horizontal pedestal base element with a front edge, rear edge, two side edges, a flat bottom surface and a generally flat upper surface, said pedestal base element having a longitudinal axis extending from the front edge to the rear edge, said upper surface having two elongated channels formed therein, one along each side edge;

wherein said pedestal is joined to the press by insertion of the pedestal base element onto the holding plate upper surface, whereby the base element channels engage the holding plate elongated channels, said holding plate wing nut being adapted to firmly hold the pedestal in place on the holding plate.

12. A thermal transfer press as recited in claim 11, wherein:

said pedestal has a generally rectangular vertical support element formed near to the base front edge, extending from the base upper surface at right angles to the base upper surface vertically upward, said vertical support element terminating at its highest point in a right angle flange, said flange lying in a plane parallel to the plane of the base upper surface and extending rearwardly.

* * * * *